US006792687B2

(12) United States Patent
Arent et al.

(10) Patent No.: US 6,792,687 B2
(45) Date of Patent: Sep. 21, 2004

(54) ADJUSTABLE TOOL FOR CUTTING RAFTERS

(76) Inventors: Richard Arent, 334 Winnehago Ave., Menasha, WI (US) 54952; Dennis Wordell, N2080 Teal Trail, Hortonville, WI (US) 54944

( * ) Notice: Subject to any disclaimer, the term of this patent is extended or adjusted under 35 U.S.C. 154(b) by 0 days.

(21) Appl. No.: 10/346,670

(22) Filed: Jan. 17, 2003

(65) Prior Publication Data

US 2003/0131487 A1 Jul. 17, 2003

(51) Int. Cl.[7] ..... B43L 7/10

(52) U.S. Cl. ..... 33/471; 33/465; 33/417; 33/538

(58) Field of Search ..... 33/452, 465, 471, 33/562, 415–417, 534, 538

(56) References Cited

U.S. PATENT DOCUMENTS 1,869,358 A * 8/1932 Golden ..... 33/471
4,422,245 A * 12/1983 Schiller ..... 33/403
4,481,720 A * 11/1984 Sury ..... 33/451
4,611,407 A * 9/1986 van Gorp ..... 33/471
5,230,158 A * 7/1993 Wall ..... 33/759
5,239,762 A * 8/1993 Grizzell ..... 33/474
5,419,053 A * 5/1995 Kathan ..... 33/417
6,122,834 A * 9/2000 Rester ..... 33/474
6,148,531 A * 11/2000 Economaki ..... 33/465
6,330,752 B1 * 12/2001 Ellam ..... 33/471
6,536,124 B1 * 3/2003 Eskew et al. ..... 33/471
6,578,279 B1 * 6/2003 Moon ..... 33/481
6,591,511 B1 * 7/2003 Carroll et al. ..... 33/474
6,694,633 B1 * 2/2004 Nyquist ..... 33/452

* cited by examiner

*Primary Examiner*—Diego Gutierrez
*Assistant Examiner*—Yaritza Guadalupe
(74) *Attorney, Agent, or Firm*—Jansson, Shupe & Munger, LTD

(57) ABSTRACT

An adjustable tool, and method of use thereof, for use in cutting a workpiece having a face extending between first and second opposite borders is disclosed. The tool preferably comprises an elongate guide member having proximal and distal ends, a bottom surface and a primary side including a straight-edge; a post fixed at the proximal end; an arm extending from the guide member, having measurement indicia marked thereon and defining a slot; and a movable pin positionable in the slot, the pin adapted to be secured at a desired location corresponding to a desired measurement indicium. The post and the pin are adapted to simultaneously contact the first border of the workpiece so that the straight-edge identifies a desired cutting line corresponding to the desired measurement indicium.

20 Claims, 4 Drawing Sheets

ADJUSTABLE TOOL FOR CUTTING RAFTERS

RELATED APPLICATIONS

This application claims all rights of priority to U.S. Provisional Application Serial No. 60/350,327, entitled "Pistol Square" filed by the present inventors on Jan. 17, 2002. The entire content of this prior provisional application is hereby fully incorporated herein by reference.

FIELD OF THE INVENTION

This invention relates generally to measuring devices, and in particular, to a tool for identifying measured cutting lines on workpieces.

BACKGROUND OF THE INVENTION

There are a number of existing devices that have been separately used by carpenters to assist in marking and cutting various dimensions, such as pitch angles of rafters. However, these devices do not provide for ease of use. For instance, when using a triangular rafter square, the base typically must be aligned with a rafter edge before the square is pivoted about the rafter square pivot to allow the user to align the rafter edge with a measurement indicia on the square. The square typically must then be held in place while the user marks the cutting line along the hypotenuse of the square. Then the square is removed and a cut is made along the marked line. This process may need to be repeated for numerous rafters and is inefficient.

In addition to being inefficient, such squares typically must sacrifice ease of use for the ability to mark or cut long distances, or vice versa. For instance, a typical seven inch rafter square has a hypotenuse of less than ten inches. For cuts longer than ten inches, the user must mark the cutting line and then remove the square from its initial position and place a straight-edge along the cutting line to provide for further markings beyond ten inches. While it is possible to use rafter squares having much longer hypotenuses, such squares are awkward in use due to the required leg lengths and are difficult to carry at the job site.

There remains a need for a simple, durable, inexpensive, multi-purpose device which is capable of accurately preparing cutting lines for roof rafters, allows for ease of use and provides for long cuts without being difficult to store or carry. Such a device should be compact, portable, easy and rapid to use and not require the use of any additional or supplemental instruments. An improved tool and method of use thereof which addresses these needs would be an important advance in the art.

The adjustable tool of the current invention provides a means for repeatedly identifying desired cutting lines without requiring re-measuring steps. The adjustable tool of the current invention also provides for the identification of several different desired cuts during construction of rafters by a single device that fits easily into the carpenter's tool pouch. Furthermore, the tool allows for the elimination of marking steps since it provides for cutting along its straight-edge while engaging the workpiece. The tool also satisfies the other noted needs in the field.

OBJECTS OF THE INVENTION

It is an object of the invention to provide an improved tool for cutting workpieces.

Another object of the invention is to provide an adjustable tool which has a movable pin which can be adjusted and secured to provide for identical repeated cuts on successive workpieces Another object of the invention is to provide an adjustable tool which allows for accurate cutting of workpieces without requiring the marking of the workpieces before cutting.

Another object of the invention is to provide an adjustable tool which is easily stored and transported in a carpenter's tool pouch.

Another object of the invention is to provide a tool which has a post and pin which separately engage a single workpiece border to provide a cutting line across the surface of the workpiece.

Another object of the invention is to provide a tool which has a post and pin which is movable independent of the post to provide the ability to engage a single workpiece border at to provide a cutting lines at various angles across the surface of the workpiece.

Another object of the invention is to provide a tool which identifies a desired cutting line on a workpiece and includes a handle to grip during cutting.

Another object of the invention is to provide a "b"-shaped tool which allows identification of cutting lines on a workpiece.

Another object of the invention is to provide a tool which engages a workpiece during cutting and provides fixed cutting lines at any angle between 0° and 90°.

Another object of the invention is to provide a method of use of the improved adjustable tool which allows users to efficiently cut along desired cut lines of successive workpieces without requiring any re-measurement.

Still another object of the invention is to provide a method of use which provides for cutting of a workpiece without removing the line-identifying tool from the workpiece surface.

Yet another object of the invention is to provide a method of producing common-rafter, hip-rafter and seat cuts using a tool having a fixed post and an adjustable pin which engage the border of the workpiece being cut.

How these and other objects are accomplished will become apparent from the following descriptions and the drawings.

SUMMARY OF THE INVENTION

This invention is an adjustable tool for use in cutting workpieces, such as rafters, which have faces extending between first and second opposite borders. The invention represents a significant advance over the state of the art by providing novel elements which can be utilized in a novel method to efficiently cut workpieces along desired cutting lines.

The adjustable cutting tool includes an elongate guide member, a post fixed to the guide member, an arm extending from the guide member and defining a slot, and a movable pin positioned in the slot and adapted to be secured at a desired location corresponding to a desired measurement indicium. The arm defines first and second external edges while the slot defines first and second internal edges. Each of these four edges may have measurement indicia marked thereon, including common-rafter, hip-rafter, seat cut and/or angle degree measurement indicia. The arm and slot are both preferably curvilinear.

The guide member has a proximal and distal end, a top and bottom surface and a primary and secondary side. The primary side includes a straight-edge which preferably has indicium indicating English or metric length units. The arm and a handle preferably extend from the secondary side and connect to form a void with the handle being adapted to be gripped by a user during cutting of a workpiece. It is preferred that the guide member, arm and handle be integrally formed.

The post is preferably fixed to the proximal end and is perpendicular to the guide member. In certain preferred embodiments, the post is formed integrally with the guide member. The post preferably extends beyond the bottom and/or top surface. The pin is preferably a bolt or of similar construction and also extends beyond the bottom and/or top surface. In certain embodiments, the pin is adapted to be secured at a location in the slot corresponding to a desired measurement indicium by using a tightening mechanism, e.g., by tightening a nut on the pin. When the pin is secured at a desired location, the post and pin are adapted to simultaneously contact the first border of the workpiece so that the straight-edge identifies a desired cutting line corresponding to the desired measurement indicium.

In certain embodiments, the tool includes a notched groove for providing the ability to insert a marking instrument therein and by sliding the tool along the workpiece while the post and pin engage the first border to scribe the workpiece.

In certain embodiments, the tool includes at least one level mounted within the tool normal to the straight-edge and parallel to the bottom surface. In other embodiments the tool includes at least one level mounted within the tool parallel to the straight-edge and to the bottom surface.

The invention can also be described as a tool which includes: 1) an elongate guide member having a midpoint equidistant from a proximal and distal end, a bottom surface and a primary side, the primary side including a straight-edge; 2) a post fixed at the proximal end; 3) an arm connected to the guide member between the proximal end and the midpoint, the arm having measurement indicia marked thereon and first and second external edges with a slot therebetween; 4) a movable pin positionable in the slot, the pin adapted to be secured at a desired location corresponding to a desired measurement indicium; and 5) a handle connected to the guide member at the proximal end, the handle connected to the arm to form a void. In such a tool, the post and the pin are adapted to simultaneously engage the first border of the rafter while the bottom surface rests on the face of the rafter so that the straight-edge identifies a desired cutting line corresponding to the desired measurement indicium. In addition, the handle of such a tool is adapted to be gripped while the post and pin engage the first border to enable a user to ensure engagement between the post and pin and the first border during cutting.

In such a tool the slot preferably defines first and second internal edges which, along with the first and second external edges, have measurement indicia marked thereon. Most preferably, common-rafter indicia is marked on the first external edge, hip-rafter indicia is marked on the first internal edge, seat cut indicia is marked on the second internal edge and angle indicia is marked on the second external edge.

It is further preferred that the guide member, post, arm and handle be integrally formed. In addition, it is preferred that the movable pin include a tightening mechanism which can be loosened to allow the location of the pin to be adjusted and tightened to secure the pin at the desired location.

In certain preferred embodiments the tool is "b"-shaped such that it includes 1) an elongate distal portion which is sufficiently long as to identify any desired cutting line without requiring use of another tool to extend the cutting line, and 2) an annular portion connected at the proximal end and including a portion having measurement indicia and a handle portion.

The invention also includes a method of cutting a rafter along a desired cutting line which comprises providing the adjustable tool, securing the moveable pin at a desired location corresponding to a desired measurement indicium; placing the bottom surface of the guide member on the face of the rafter so that the post and pin engage the first border of the rafter; and cutting the rafter along the straight-edge.

In the preferred method the tool comprises an elongate guide member having a proximal and distal end, a bottom surface and a primary side, the primary side including a straight-edge; a post fixed at the proximal end; an arm extending from the guide member, the arm having measurement indicia marked thereon and first and second external edges with a slot therebetween; and a movable pin positionable in the slot. In certain embodiments, the tool may further include a handle adapted to be gripped by a user while the user cuts the rafter. In such embodiments the method also includes the step of gripping the handle and holding the tool so that the post and pin remain engaged with the first border during the cutting step.

It is preferable that the cutting step be performed while the post and pin engage the first border so that the desired cutting line need not be marked on the rafter. In other words, the user need not position the tool, mark the cutting line, remove the tool and then cut the rafter. Instead, the user need only position the tool and cut the rafter while holding the tool.

The inventive method also provides that the placing and cutting steps be repeated for a second rafter which results in first and second rafters having identical cuts without requiring measurement of the angle between the cut and the first border before cutting the either rafter. That is, once the desired measurement indicia is identified and the movable pin is secured at a location corresponding to the desired measurement indicia, repeated cuts can be performed on successive rafters without requiring any angle measurement of the rafters or marking of the rafters. In fact, by adjusting and securing the position of the movable pin in the inventive method angle measurements on the rafters are never required.

DETAILED DESCRIPTION OF PREFERRED EMBODIMENTS

Figure 1:
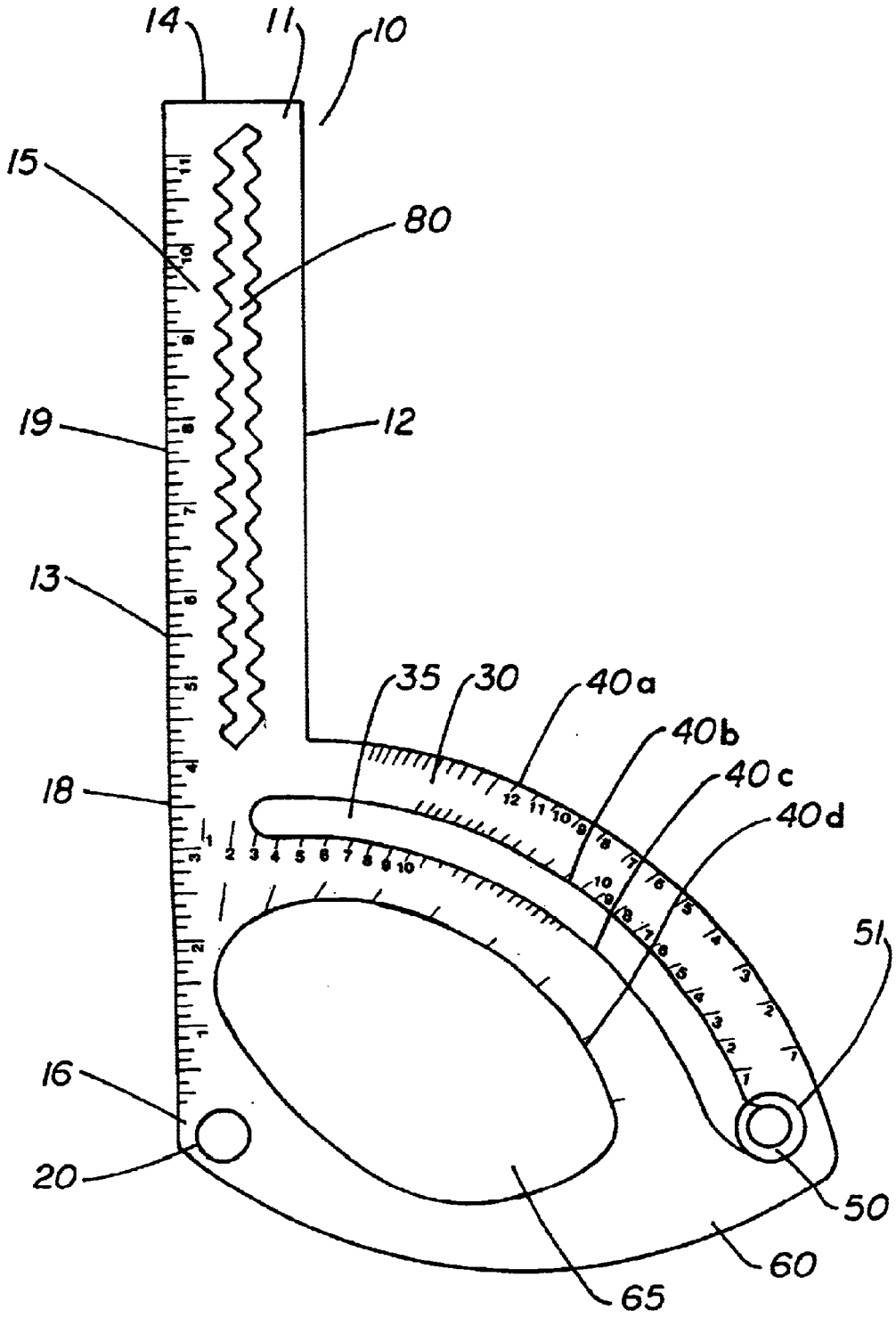
FIG. 1 is an overhead view of the tool in accordance with the present invention.

Referring to the figures, details of the adjustable tool for use in cutting a workpiece will be set forth. FIG. 1 depicts an overhead view of a preferred embodiment of tool 10 which comprises a guide member 15, post 20, arm 30, movable pin 50 and handle 60. Preferably, guide member 15, post 20, arm 30, and handle 60 are integrally formed from a plastic or similar material.

Figure 2:
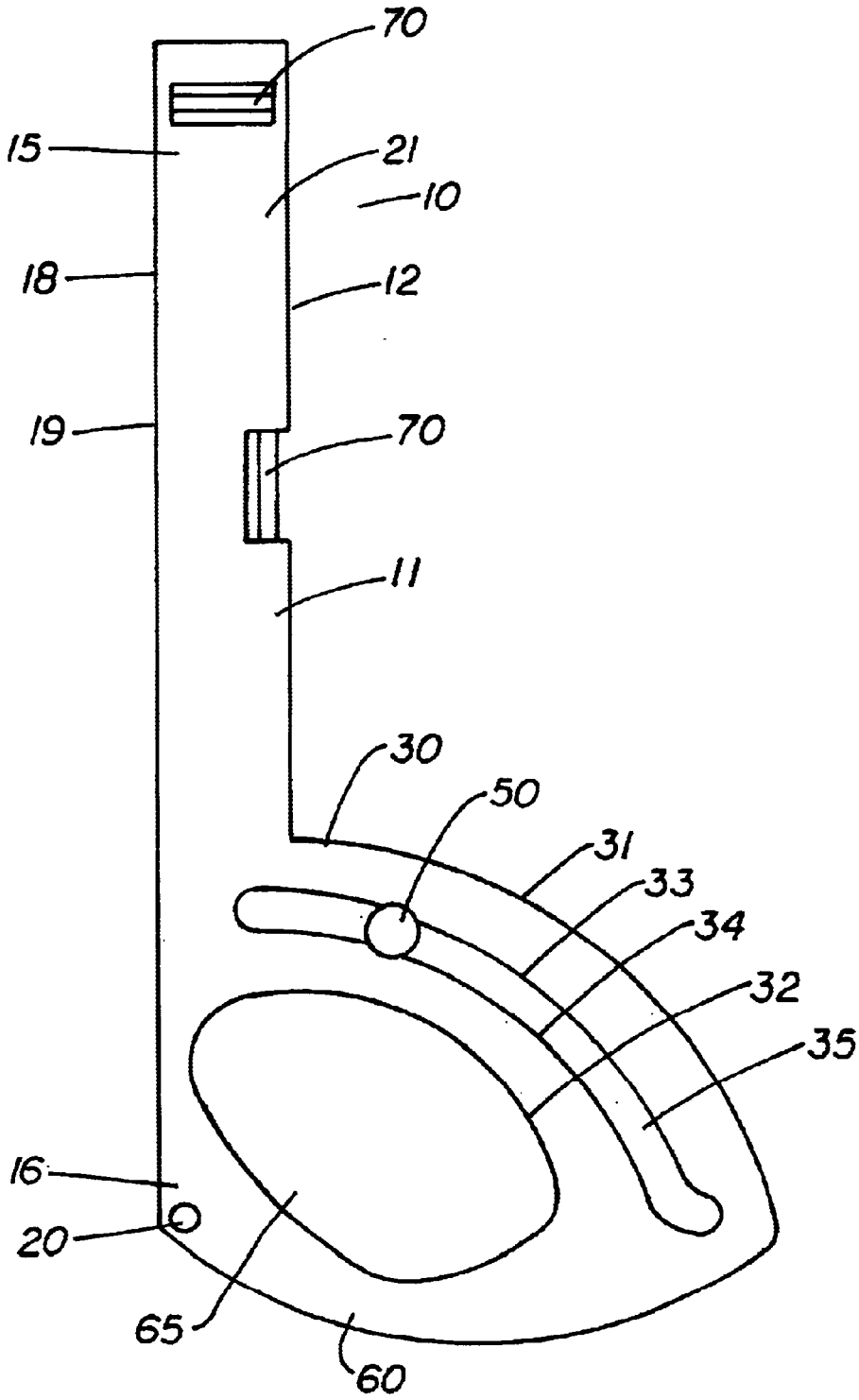
FIG. 2 is an overhead view of the tool in a preferred embodiment in accordance with the present invention.

Guide member 15 extends from distal end 14 to proximal end 16 and has a primary side 18 and secondary side 12. A straight-edge 19 with typical English or metric length markings is located on primary side 18. Guide member 10 includes a top surface 11 and bottom surface 17 (see FIG. 3) which are preferably planar and parallel. Guide member 15 may include a notched groove 80 which allows a user to insert a marking instrument at a notch and mark a workpiece as the tool is slid along the workpiece's border. As shown in FIG. 2, tool 10 may also include at least one level 70 which is mounted parallel to top and bottom surfaces 11, 17. In certain embodiments, tool 10 may include a level 70 normal to straight-edge 19 and a level 70 parallel to straight-edge 19.

Post 20 is fixed to guide member 15 at or near proximal end 16. Post 20 is preferably integrally formed with guide member 15, extends beyond top and/or bottom surfaces 11, 17 and is perpendicular to top and bottom surfaces 11, 17.

Arm 30 extends from secondary side 12 of guide member 15 and is generally curvilinear. It is preferred that arm 30 connect to guide member 15 at a position between midpoint 13 and proximal end 20 such that guide member includes a distal portion 21 extending beyond arm 30. Distal portion 21 can be inserted into a carpenter's tool pouch to provide for easy transport of tool 10. Arm 30 has a top and bottom surface 11,17 (see FIG. 3), a first external edge 31 and a second external edge 32 (see FIG. 2). Arm 30 also includes a curvilinear slot 35 which defines a first internal edge 33 and second internal edge 34 (see FIG. 2). Measurement indicia 40 are preferably marked on both top and bottom surfaces 11,17 at first and second external and internal edges 31,32,33,34 so that tool 10 allows for "right-handed" or "left-handed" use. As shown in FIG. 1, common rafter measurement indicia 40*a* is marked at first external edge 31, hip rafter measurement indicia 40*b* is marked at first internal edge 33, seat cut measurement indicia 40*c* is marked at second internal edge 34 and angle measurement indicia 40*d* is marked at second external edge 32. However, the invention does not require that each edge have measurement indicia marked thereon, nor does it require such specific measurement indicia marked at each specific edge.

Figure 3:
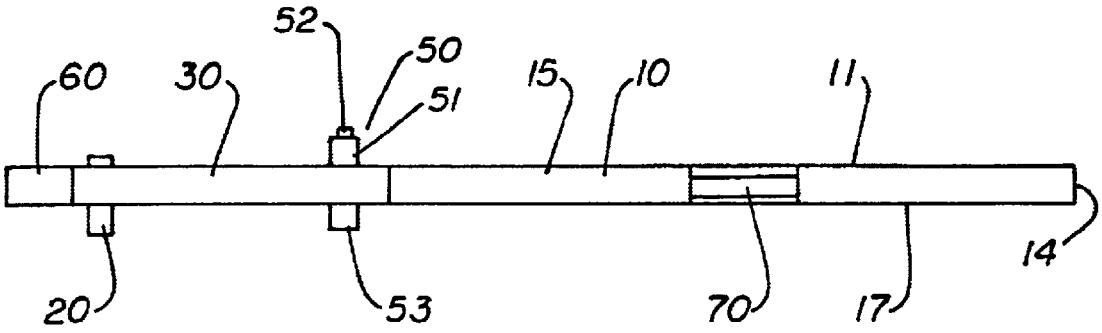
FIG. 3 is a side view of the tool shown in FIG. 2.

Positioned in slot 35 is movable pin 50. As shown in FIG. 3, movable pin 50 includes a head 53 which engages bottom surface 17, a shaft 52 which passes through slot 35 and a tightening mechanism 51 which is depicted as a nut. Tightening mechanism 51 can be loosened to allow pin 50 to be moved to a desired location and then tightened so that pin 50 remains in the desired location during use.

Handle 60 preferably connects arm 30 to proximal end 16 of guide member 15. Handle 60 and arm 30 form void 65 and allows a user to grip tool 10 during use. While tool 10 is stored in a tool pouch, handle 60 is easily grasped by a user.

Figure 4:
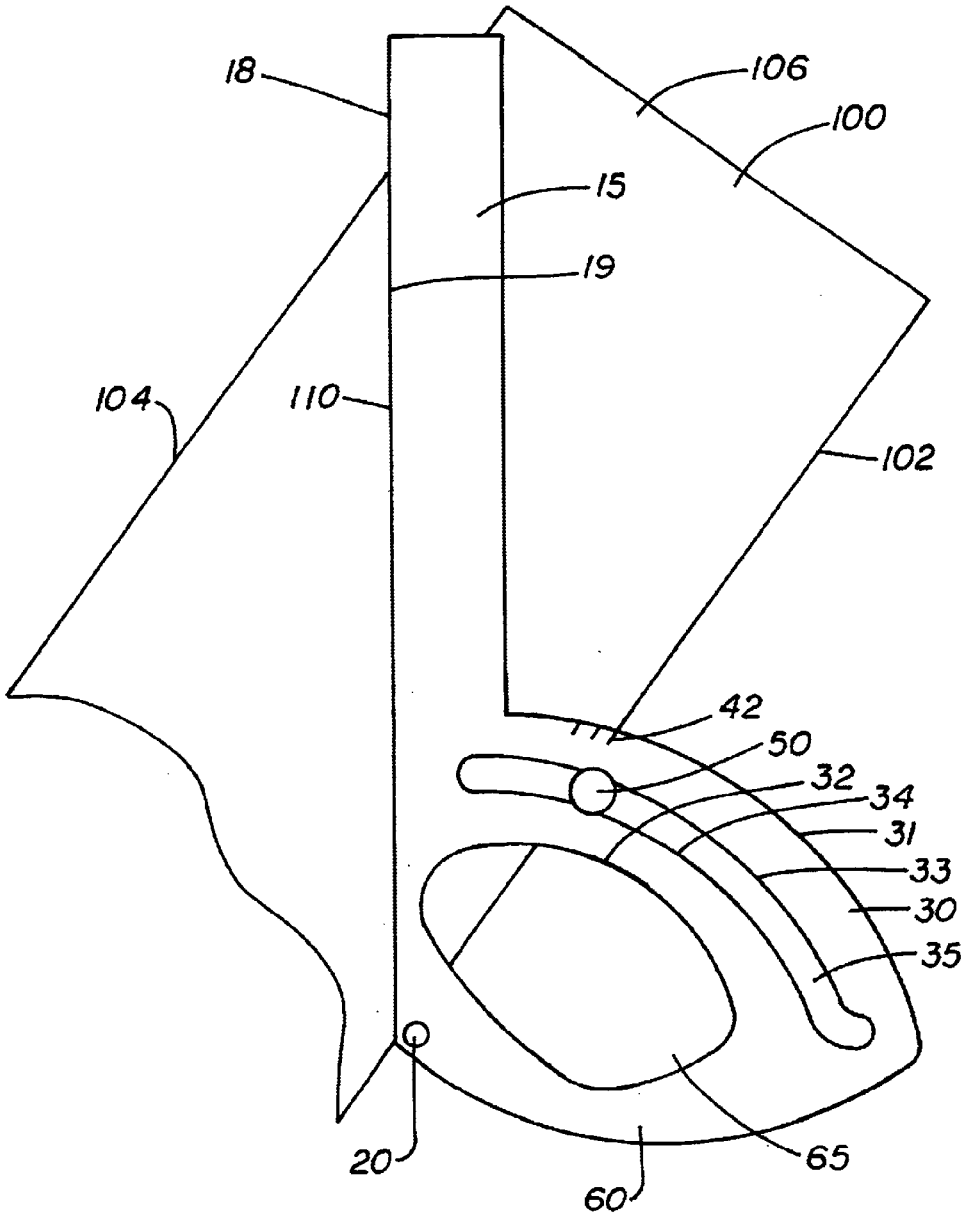
FIG. 4 is an overhead view of the tool shown engaging a workpiece in accordance with the present invention.

FIG. 4 depicts adjustable tool 10 in use. Workpiece or rafter 100 is shown having a first border 102, second border 104 and face 106 extending therebetween. After the desired cut is identified, movable pin 50 is adjusted and tightened at the desired measurement indicia 42 corresponding to the desiredcut. Tool 10 is then positioned such that pin 50 and post 20 engage first border 102 as shown. While holding handle 60, with the right hand as shown, rafter 100 may be cut by a user with his left hand along cutting line 110. It is noted that cutting line 110 could simply be marked while holding tool 10 in engagement with rafter 100 depending on the needs of the user. In addition, it can be seen that tool 10 can be repositioned on successive rafters for cutting along cutting lines without requiring re-measurement of the intended cut.

It is also noted that pin 50 and post 20 each extend through top and bottom surfaces 11, 17 so that the user may hold handle 60 with his left hand, contact border 104 with pin 50 and post 20 and cut rafter 100 with his right hand.

In the prior art, seat cuts were typically formed by marking a normal common-rafter or hip-rafter cutting line and then aligning a dashed line on the surface of the rafter square with the cutting line and drawing a seat cut line along the rafter square hypotenuse. In the current invention, such seat cuts are formed by fixing the movable pin at the desired common-rafter or hip-rafter indicia, engaging the border with the pin and post, marking or cutting along the straight-edge and then adjusting the movable pin to the corresponding seat cut indicia, engaging the border with the pin and post, and marking or cutting along the straight-edge. In such a method, the seat cut line is identified using the opposite "hand" from the initial cut. For instance, if the common-rafter cutting line were cut or marked with the right hand while holding the tool with the left hand, then the seat cut line would be cut or marked with the left hand while holding the tool with the right hand.

While the principles of this invention have been described in connection with specific embodiments, it should be understood clearly that these descriptions are made only by way of example and are not intended to limit the scope of the invention.

The claimed invention is:

1. A tool for use in cutting a workpiece, the workpiece having a face extending between first and second opposite borders; the tool comprising:

an elongate guide member having a proximal and distal end, a bottom surface and a primary side, the primary side including a straight-edge;

a post fixed at the proximal end;

an arm extending from the guide member, the arm defined by first and second external edges and having measurement indicia and a slot positioned between the first and second external edges, each of the first and second external edges intersecting the guide member between the post and the midpoint; and a movable pin positionable in the slot, the pin adapted to be secured at a desired location corresponding to a desired measurement indicium;

whereby the post and the pin are adapted to simultaneously contact the first border of the workpiece so that the straight-edge identifies a desired cutting line corresponding to the desired measurement indicium.

2. The tool of claim 1 wherein the arm is further connected to the guide member by a handle so that the arm and handle to form a void, the handle adapted to be gripped by a user during cutting of the workpiece.

3. The tool of claim 2 wherein the guide member, arm and handle are integrally formed.

4. The tool of claim 1 wherein the slot defines first and second internal edges, the first and second external edges and the first and second internal edges having measurement indicia marked thereon.

5. The tool of claim 4 wherein the measurement indicia includes common-rafter indicia, hip-rafter indicia, seat cut indicia, and angle indicia.

6. The tool of claim 1 wherein the post is formed integrally with the guide member.

7. The tool of claim 1 further including at least one level mounted within the tool and normal to the straight-edge and parallel to the bottom surface.

8. The tool of claim 1 further including at least one level mounted within the tool and parallel to the straight-edge and to the bottom surface.

9. The tool of claim 1 wherein the pin is adapted to be secured at the desired location in the slot by tightening a tightening mechanism on the pin.

10. The tool of claim 1 wherein the slot is curvilinear.

11. A tool for use in cutting a rafter, the rafter having a face extending between first and second opposite borders; the tool comprising:

an elongate guide member having a midpoint equidistant from a proximal and distal end, a bottom surface and a primary side, the primary side including a straight-edge;

a post fixed at the proximal end;

an arm connected to the guide member and defined by first and second external edges, the arm connected to the guide member only between the proximal end and the midpoint of the guide member, the arm having measurement indicia marked thereon and and a slot;

a movable pin positionable in the slot, the pin adapted to be secured at a desired location corresponding to a desired measurement indicium; and a handle connected to the guide member at the proximal end, the handle connected to the arm to form avoid;

whereby the post and the pin are adapted to simultaneously engage the first border of the rafter while the bottom surface rests on the face of the rafter so that the straight-edge identifies a desired cutting line corresponding to the desired measurement indicium, and the handle is adapted to be gripped while the post and pin engage the first border to enable a user to ensure engagement between the post and pin and first border during cutting.

12. The tool of claim 11 wherein the movable pin includes a tightening mechanism adapted to be loosened to allow the location of the pin to be adjusted and tightened to secure the pin at the desired location.

13. The tool of claim 11 wherein the guide member, post, arm and handle are integrally formed.

14. The tool of claim 11 wherein the slot defines first and second internal edges, the first and second external edges and first and second internal edges having measurement indicia marked thereon.

15. The tool of claim 14 wherein common-rafter indicia is marked on the first external edge, hip-rafter indicia is marked on the first internal edge, seat cut indicia is marked on the second internal edge and angle degree indicia is marked on the second external edge.

16. The tool of claim 11 wherein the tool is "b"-shaped.

17. A method of cutting a rafter along a desired cutting line, the rafter having first and second opposite borders and a face extending therebetween, the method comprising:

providing a tool including:

an elongate guide member having a midpoint equidistant to a proximal and distal end, a bottom surface and a primary side, the primary side including a straight-edge;

a post fixed at the proximal end;

an arm extending from the guide member, the arm defined by first and second external edges which connect to the guide member between the midpoint and the proximal end, the arm having measurement indicia marked thereon and a slot; and a movable pin positionable in the slot;

securing the moveable pin at a desired location corresponding to a desired measurement indicium;

placing the bottom surface of the guide member on the face of the rafter so that the post and pin engage the first border of the rafter; and cutting the rafter along the straight-edge.

18. The method of claim 17 wherein the tool includes a handle adapted to be gripped by a user while the user cuts the rafter, and further including the step of gripping the handle and holding the tool so that the post and pin remain engaged with the first border during the cutting step.

19. The method of claim 17 wherein the cuffing step is performed while the post and pin engage the first border so that the desired cutting line is not marked on the rafter.

20. The method of claim 17 wherein the rafter is a first rafter and the placing and cutting steps are repeated for a second rafter, whereby the method results in first and second rafters having identical cuts without requiring re-measurement of the angle between the cut and the first border before cutting the second rafter.

* * * * *

UNITED STATES PATENT AND TRADEMARK OFFICE

CERTIFICATE OF CORRECTION

PATENT NO. : 6,792,687 B2
DATED : September 21, 2004
INVENTOR(S) : Arent et al.

It is certified that error appears in the above-identified patent and that said Letters Patent is hereby corrected as shown below:

Title page,
Insert -- Item [62], Related U.S. Application Data, Provisional application No. 60/350,327, filed on Jan. 17, 2002. --

Column 7,
Line 22, delete "avoid" and substitute therefor -- a void --.

Signed and Sealed this

Thrid Day of May, 2005

JON W. DUDAS
*Director of the United States Patent and Trademark Office*